United States Patent [19]

Coleman, III

[11] Patent Number: 5,067,504

[45] Date of Patent: Nov. 26, 1991

[54] ASBESTOS COLLECTION AND CONTAINMENT DEVICE

[76] Inventor: Seab H. Coleman, III, P.O. Box 43001, Richman Heights, Ohio 44143

[21] Appl. No.: 616,906

[22] Filed: Nov. 21, 1990

[51] Int. Cl.[5] ..... B08B 3/02

[52] U.S. Cl. ..... 134/172; 15/321; 55/DIG. 3; 55/94; 98/115.4; 134/198; 134/201; 182/129

[58] Field of Search ..... 134/104.2, 104.3, 104.4, 134/110, 167 R, 168 R, 172, 174, 198, 201; 15/321; 98/115.4; 55/DIG. 3, 94, 429; 182/129; 135/900; 118/DIG. 7, 326

[56] References Cited

U.S. PATENT DOCUMENTS

| | | | |
|---|---|---|---|
| 2,280,984 | 4/1942 | Thurnau | 98/115.4 X |
| 3,485,671 | 12/1969 | Stephens | 55/429 X |
| 4,765,352 | 7/1988 | Strieter | 134/172 X |
| 4,782,844 | 11/1988 | Hughes | 134/201 X |
| 4,809,391 | 3/1989 | Soldatovic | 98/115.4 X |
| 4,852,687 | 7/1989 | Hittler | 182/129 |
| 4,911,188 | 3/1990 | Seidel | 134/198 X |
| 4,911,191 | 3/1990 | Bain | 134/201 X |

*Primary Examiner*—Philip R. Coe

*Attorney, Agent, or Firm*—Harpman & Harpman

[57] ABSTRACT

An asbestos collection and containment device for use in the removal of asbestos from ceiling or other accessible elevated asbestos covered structures. The collection device contains and directs the removed asbestos into a scaffold supported flexible walled enclosure having a constant exhaust air flow filtration and associated wetting apparatus. The asbestos collection device is a mobile self-contained containment removal structure that automatically bags the removed asbestos for approved disposal.

6 Claims, 2 Drawing Sheets

ASBESTOS COLLECTION AND CONTAINMENT DEVICE

BACKGROUND OF THE INVENTION

1. Technical Field

This device relates to the removal of asbestos from buildings and the like where it is necessary to maintain a clean removing environment by use of negative air enclosures, bagging of the removed asbestos and reduced contamination of the work area during processing.

2. Description of Prior Art

Prior Art devices of this type have relied on a variety of different asbestos containment removal systems to attempt to collect and remove asbestos from the general environment in both a self-contained isolated and negative air maintained rooms and structures, see for example U.S. Pat. Nos. 4,765,392, 4,911,191 and U.S. Pat. Nos. 4,782,844 and 4,852,687.

In U.S. Pat. No. 4,765,352 a portable isolation enclosure is disclosed in which a workman is placed into an adjustable height booth that maintains a seal with the work area. A negative air system is used to maintain negative air pressure within the booth in which the contaminated workman is enclosed and works.

In U.S. Pat. No. 4,911,191 a ceiling protection work area apparatus is shown in which a fiber tight bag with an open top is positioned adjacent a ceiling with flexible work gloves secured within the bag side. The operator stands adjacent the bag utilizing the sealed gloves extending through the bag side wall to remove asbestos which is maintained within the enclosed bag structure.

U.S. Pat. No. 4,852,687 discloses a removable structure and method wherein a plastic enclosure extends upwardly and outwardly from the periphery of an elevated support platform. A transfer shoot is mounted in the side of the enclosure for the disposal of asbestos. The workman stands within the enclosure on the elevated platform removing asbestos and placing same within the transfer shoot in the side wall of the enclosure so that it can be bagged at the bottom of the shoot.

SUMMARY OF THE INVENTION

An asbestos collection and containment device for the selective self-contained removal and bagging of asbestos from the environment. The asbestos collection device has a portable support structure with a flexible walled enclosure within the structure positioned so as to be adjacent a work surface from which the asbestos is to be removed. The flexible wall enclosure funnels the removed contaminated material directly into disposal bags independently supported by the support structure. A wetting wand is movably positioned on the structure over the flexible walled enclosure and a decontamination air flow is established within the upper portion of the enclosure adjacent the work surface on which the material is to be removed therefrom.

DESCRIPTION OF THE PREFERRED EMBODIMENT

Figure 1:
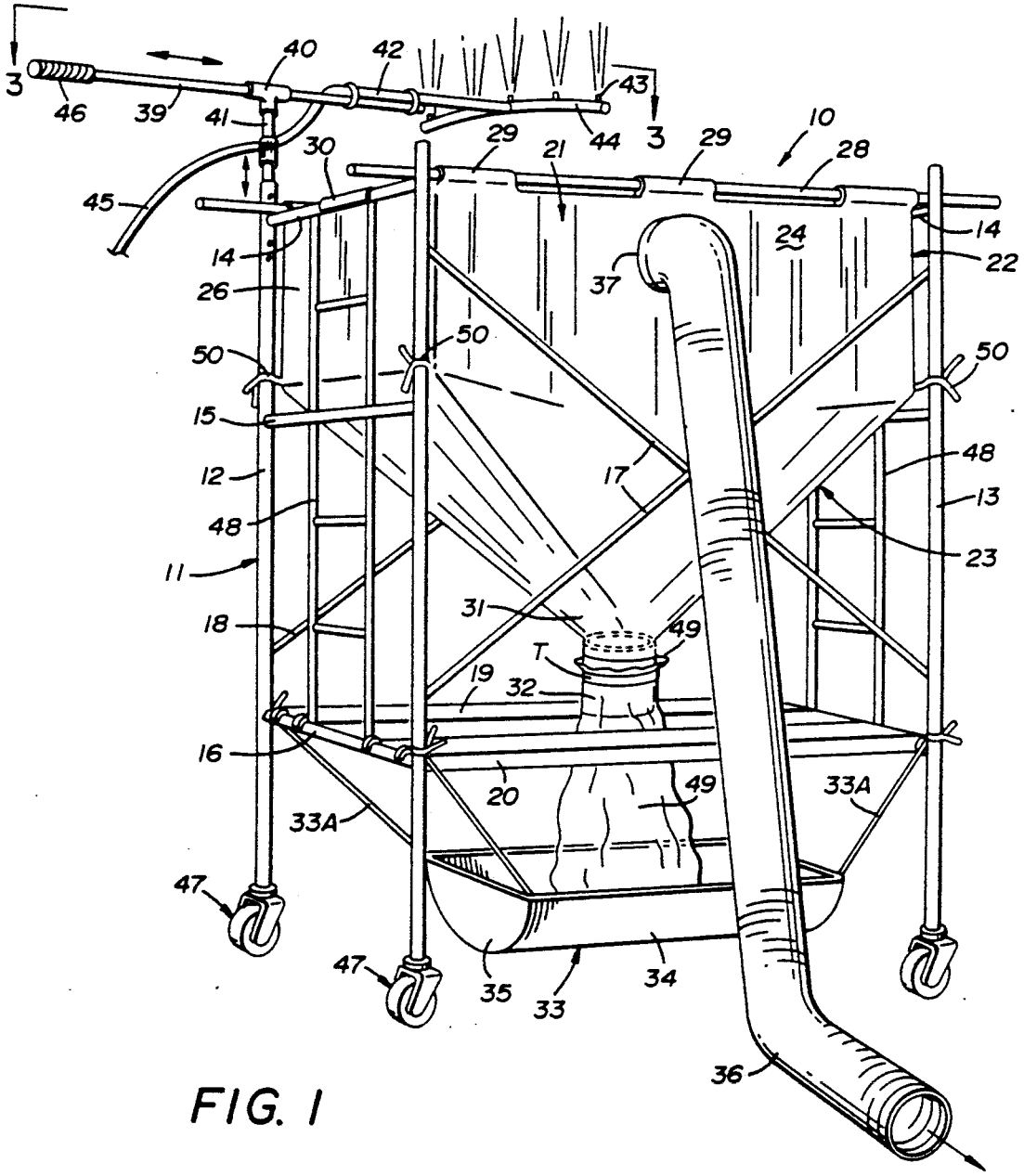
FIG. 1 is a perspective view of the asbestos collection and containment device.
Figure 2:
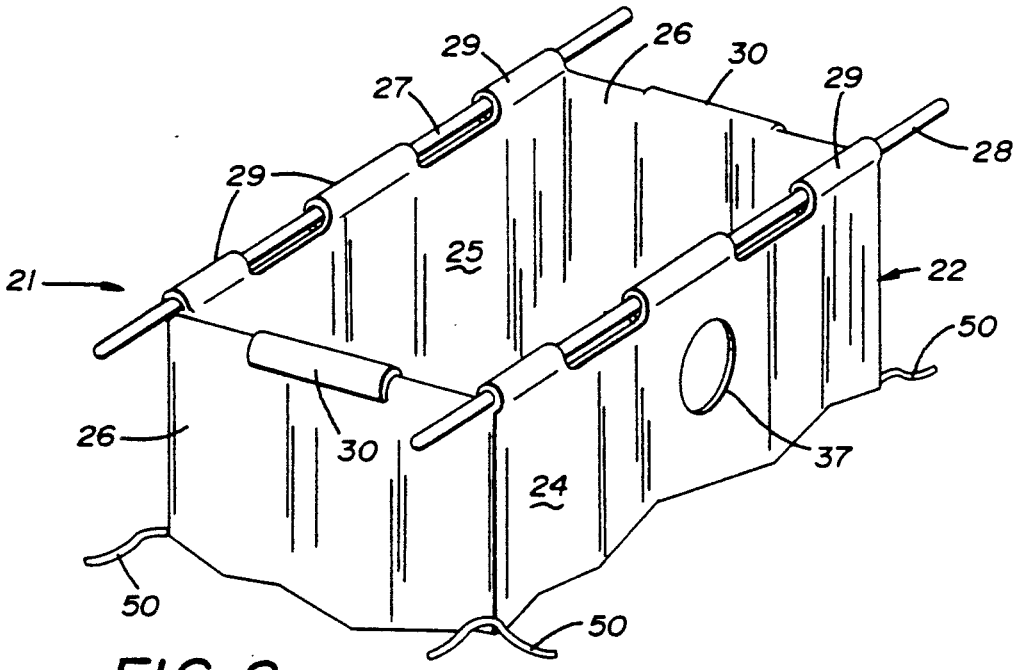
FIG. 2 is an enlarged perspective view of a portion of the asbestos collection and containment device.

An asbestos collection and containment device 10 can be seen in FIGS. 1 and 2 of the drawings comprising a main support scaffolding 11 having a pair of oppositely disposed vertically aligned scaffold elements 12 and 13. The scaffold elements 12 and 13 each have spaced multiple horizontally disposed cross members 14,15, and 16 as are well known within the art. The scaffold elements 12 and 13 are innerconnected to one another by pairs of intersecting cross support rods 17 and 18 and horizontally aligned and spaced staging platforms 19 and 20 extending therebetween from said respective cross member 16. The above described combination of structural elements defines a self-supporting mobile support for a flexible asbestos containment enclosure 21. The flexible asbestos containment and enclosure 21 is of a continuous fabric construction having an upper portion 22 and a lower portion 23. The upper portion 22 has integral front walls, back and side walls 24,25, and 26 respectively arranged in a general rectangular shape having an open top and a transition bottom extending integrally into said lower portion. Referring now to FIG. 2 of the drawings it can be seen that a pair of closure and support rods 27 and 28 are removably secured to a series of longitudinally spaced tab extensions 29 extending from the free edges of said front and back walls 24 and 25 and extend outwardly therefrom to act as upper containment enclosure supports resting on said respective cross support rods 14, best seen in FIG. 1 of the drawings. A secondary tab 30 extends from each of said side walls 26 for selective removable engagement with said cross support rods 14 as will be well understood by those skilled in the art. The lower portion 23 of the flexible asbestos containment enclosure 21 is of a funnel configuration at 31 extending to an terminating with a cylindrical rigid sleeve 32 extending therefrom. Said sleeve 32 is of an area of reduced transverse dimension relative said flexible asbestos containment enclosure 21 and is positioned centrally between said staging platforms 19 and 20 as hereinbefore described. A bag support trough 33 has a continuous side and bottom wall 34 and respective integral end walls 35 and is supported from said cross members 16 by straps 33A below said staging platforms 19 and 20 in vertical alignment with said sleeve 32.

An air intake hose 36 is secured through and to the front wall 24 of the flexible asbestos containment enclosure 21 by an opening at 37 (see FIG. 2 of the drawings) and extends therefrom to a source of negative air pressure (not shown) such as a negative air machine that intakes contaminated air near its source within the upper portion 22 at said opening 37, filters said air and exhaust same to atmosphere. Negative air machines of this type are so well known and universally used within the industry that no further explanation is deemed necessary or required to those skilled in the art.

Figure 3:
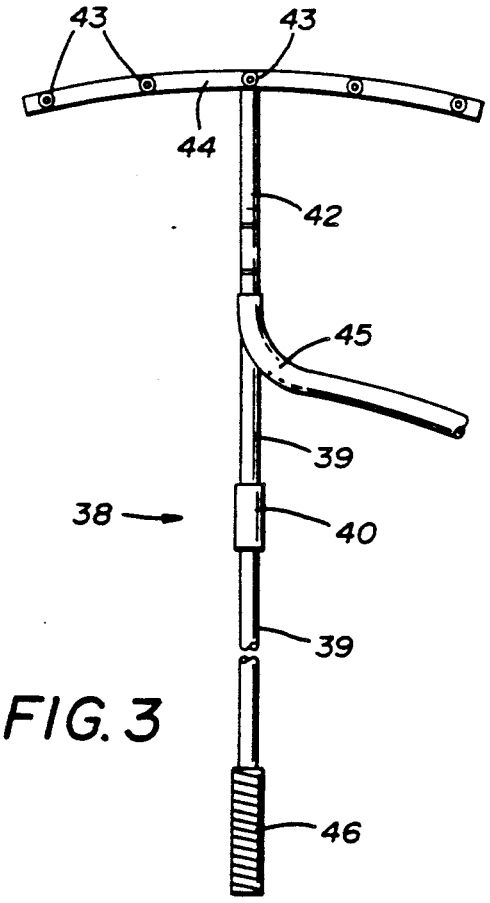
FIG. 3 is an enlarged top plan view of a wetting distribution assembly with multiple spray nozzles and source of liquid supply.

Referring now to FIGS. 1 and 3 of the drawings a wet down apparatus 38 is shown having an adjustable tubular support arm 39 extending through a T fitting 40, best seen in FIG. 1 of the drawings. A tubular support element 41 extends from said T fitting 40 to said scaffold element 12. Said support element 41 is telescopically extensible and can be extended or retracted in accordance with the required height necessary. A tubular spray arm 42 is secured to and extends from said tubular support arm 39 and is in communication with a plurality of spray nozzles 43 which are positioned in spaced arcuate relation to one another on a curved manifold 44 that extends from said spray arm 42. A flexible supply hose 45 is secured to the free end of said spray arm 42 and communicates with a source of liquid wetting agent under pressure (not shown). It will be evident from the above description that the wet down apparatus 38 can be positioned so as to spray a wetting agent such as water or the like on the work area during the removal of asbestos therefrom to keep asbestos release at a minimum.

The tubular support arm 39 can be maneuvered relative the work area via a handle 46 positioned on its respective free end.

In use, the scaffold elements 12 and 13 have wheel assemblies 47 thereon and multiple rung ladders 48 respectively that in combination allow for continuous mobile positioning of the asbestos collection and containment device below the work surface and worker access to the work surface respectively.

An asbestos disposal bag 49 is secured to the open end of said cylindrical sleeve 32 by removable adhesive type tape T and will rest and be supported within as it is filled with removed asbestos via the bag support trough 33.

A number of auxiliary support ties 50 extend from the flexible asbestos containment enclosure 21 to adjacent scaffolding elements 12 and 13 to help maintain the transition opening between said upper and lower portions 22 and 23 of said flexible asbestos containment enclosure 21 during use.

As asbestos material is removed from the work area above the asbestos collection and containment device 10 it will fall into the flexible asbestos containment enclosure 21 automatically collecting and being directed into the attached asbestos disposal bag 49. The combination of the spray from the wet down apparatus 38 and the negative air intake at the opening 37 via the air intake hose 36 as hereinbefore described will reduce the overal contamination of the work place and eliminate excessive handling of the removed asbestos material as would occur in a normal multi-stepped operation.

It will be noted from the above description that a scale down version of said asbestos collection and containment device can be used in limited work areas where size and portability of the removal collection and containment equipment is necessary.

It will thus be seen that a new and novel asbestos collection and containment device has been illustrated and disclosed and that various changes and modifications may be made therein without departing from the spirit of the invention, therefore I claim:

1. An asbestos collection and containment device for use in removing hazardous material, such as asbestos from overhead work areas comprising, an adjustable support scaffold, a flexible multi-walled containment enclosure within said support scaffold, said flexible containment enclosure having an opened upper portion and a funnel shape lower portion, said lower portion having an outlet means projecting outwardly beyond and from said lower portion within said support scaffold, ventilation means within said upper portion adjacent said open end thereof, wetting means extending from said support scaffold for indirect contact with said work area.

2. The asbestos collection and containment device of claim 1 wherein said opened upper portion of said flexible containment enclosure has closure and support rods extending therefrom engaging said support scaffolding, means for securing said rods to said open upper portion.

3. The asbestos collection and containment device of claim 2 wherein said means for securing said closure and support rods to said open upper portion of said flexible containment enclosure comprises spaced tab extensions extending from free edges of said open upper portions.

4. The asbestos collection and containment device of claim 1 wherein said outlet means comprises a transition sleeve, a removable disposal bag engageable thereover, a bag support trough suspended from said support scaffold.

5. The asbestos collection and containment device of claim 1 wherein said ventilation means comprises an air intake and hose assembly in communication with a source of negative air pressure and said upper portion of said flexible containment enclosure.

6. The asbestos collection and containment device of claim 1 wherein said wetting means comprises an extensible support arm adjustably positioned on said support scaffold, a spray arm secured to and extending from said support arm, a supply manifold in communication with said spray arm, a plurality of spaced spray nozzles on said supply manifold, means for supplying said spray arm with a source of wetting liquid under pressure.

* * * * *